US009638183B2

(12) United States Patent
Bonucci et al.

(10) Patent No.: US 9,638,183 B2
(45) **Date of Patent: *May 2, 2017**

(54) GETTER PUMP

(71) Applicant: SAES GETTERS S.P.A., Lainate (IT)

(72) Inventors: Antonio Bonucci, Milan (IT); Luca Viale, Cavenago di Brianza (IT)

(73) Assignee: SAES GETTERS S.P.A., Lainate (MI) (IT)

( * ) Notice: Subject to any disclaimer, the term of this patent is extended or adjusted under 35 U.S.C. 154(b) by 396 days.

This patent is subject to a terminal disclaimer.

(21) Appl. No.: 14/370,015

(22) PCT Filed: Sep. 24, 2013

(86) PCT No.: PCT/IB2013/058802

§ 371 (c)(1),
(2) Date: Jun. 30, 2014

(87) PCT Pub. No.: WO2014/060879

PCT Pub. Date: Apr. 24, 2014

(65) Prior Publication Data

US 2014/0369856 A1 Dec. 18, 2014

(30) Foreign Application Priority Data

Oct. 15, 2012 (IT) ..... MI2012A1732

(51) Int. Cl.
*H01J 41/00* (2006.01)
*F04B 37/02* (2006.01)
(Continued)

(52) U.S. Cl.
CPC ..... *F04B 37/02* (2013.01); *F04B 37/04* (2013.01); *F04B 37/14* (2013.01); *H01J 7/18* (2013.01); *H01J 7/183* (2013.01); *H01J 41/20* (2013.01)

(58) Field of Classification Search
CPC F04B 37/02; F04B 37/04; F04B 37/14; H01J 41/20; H01J 7/18; H01J 7/183
(Continued)

(56) References Cited

U.S. PATENT DOCUMENTS 3,662,522 A 5/1972 Della Porta et al.
4,137,012 A 1/1979 Della Porta et al.
(Continued)

FOREIGN PATENT DOCUMENTS

EP 0753663 1/1996
EP 0742370 11/1996
(Continued)

OTHER PUBLICATIONS

PCT International Search Report mailed on Feb. 5, 2014 for PCT/IB2013/058802 filed on Sep. 24, 2013 in the name of SAES GETTERS S.P.A.
(Continued)

*Primary Examiner* — Charles Freay
*Assistant Examiner* — Christopher Bobish
(74) *Attorney, Agent, or Firm* — Steinfl + Bruno LLP

(57) ABSTRACT

A getter pump is described. The getter pump has a casing, whose shape is a solid of revolution with a revolution axis, and a plurality of getter cartridges mounted within the getter pump casing, each cartridge having a linear central support and spaced getter elements mounted on the linear central support. A getter cartridge orientation plane containing the linear central support and parallel to the revolution axis, and a getter cartridge positioning plane orthogonal to the revolution axis and intersecting the midpoint of a linear central support are defined. For each cartridge, the angle formed by the getter cartridge positioning plane with the linear control supports is equal to or less than 30°.

18 Claims, 2 Drawing Sheets

Figure 1:
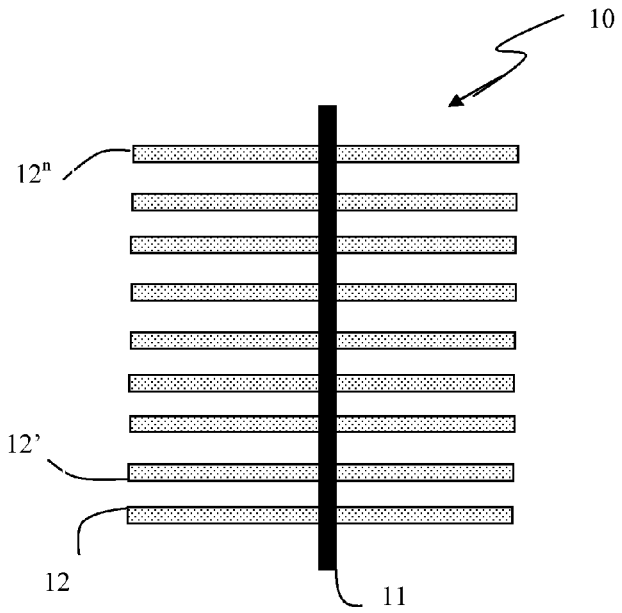

(51) Int. Cl.

| | |
|---|---|
| ***H01J 7/18*** | (2006.01) |
| ***F04B 37/04*** | (2006.01) |
| ***F04B 37/14*** | (2006.01) |
| ***H01J 41/20*** | (2006.01) |

(58) Field of Classification Search
USPC ..... 417/48, 51
See application file for complete search history.

(56) References Cited

U.S. PATENT DOCUMENTS

| | | | | |
|---|---|---|---|---|
| 5,772,404 | A * | 6/1998 | Carella | F04B 37/02 417/313 |
| 6,109,880 | A | 8/2000 | Krueger et al. | |
| 6,149,392 | A | 11/2000 | Conte | |
| 6,299,746 | B1 | 10/2001 | Conte et al. | |
| 6,309,184 | B1 * | 10/2001 | Moraja | F04B 37/02 417/199.1 |
| 8,399,861 | B2 | 3/2013 | Manini et al. | |
| 2004/0201349 | A1 | 10/2004 | Ramamoorthi et al. | |
| 2005/0072356 | A1 * | 4/2005 | Conte | F04B 37/04 118/715 |

FOREIGN PATENT DOCUMENTS

| | | | |
|---|---|---|---|
| JP | 2013165293 | A | 8/2013 |
| WO | 94/02957 | A1 | 2/1994 |
| WO | 98/58173 | | 12/1998 |
| WO | 98/58173 | A1 | 12/1998 |
| WO | 2009/118398 | | 10/2009 |
| WO | 2010/105944 | | 9/2010 |
| WO | 2014/060879 | A1 | 4/2014 |

OTHER PUBLICATIONS

International Search Report for PCT/IB2015/052174 filed Mar. 25, 2015 on behalf of SAES GETTERS S.P.A. Mail Date: Jun. 23, 2015. 4 pages.
Written Opinion for PCT/IB2015/052174 filed Mar. 25, 2015 on behalf of SAES GETTERS S.P.A. Mail Date: Jun. 23, 2015. 5 pages.
Non-Final Office Action for U.S. Appl. No. 14/786,138, filed Oct. 21, 2015 on behalf of Antonio Bonucci. Mail Date: Apr. 15, 2016. 10 pages.
Notice of Allowance for U.S. Appl. No. 14/786,138, filed Oct. 21, 2015 on behalf of Antonio Bonucci. Mail Date: Oct. 11, 2016. 8 pages.
Written Opinion for PCT/IB2013/058802 filed Sep. 24, 2013 on behalf of SAES GETTERS S.P.A. Mail Date: Feb. 5, 2014. 4 pages.

* cited by examiner

GETTER PUMP

CROSS REFERENCE TO RELATED APPLICATIONS

The present application is the US national stage of International Patent Application PCT/IB2013/058802 filed on Sep. 24, 2013which, in turn, claims priority to Italian Patent Application MI2012A001732 filed on Oct. 15, 2012.

The present invention relates to an improved getter pump comprising a plurality of getter cartridges.

Getter pumps, used alone or in combination with other types of pumps, are widely used and appreciated, and are described in various documents such as the international patent applications WO 9858173, WO 2010/105944 and WO 2009/118398 in the applicant's name.

Even though the combination of getter pumps with other types of vacuum pumps provides distinct advantages in certain applications, such as surface science systems and analyzers operating under vacuum, the use of stand-alone getter pumps is preferred when there are constraints that do not allow for such combined use, in particular when active gases such as $H_2$, CO, $CO_2$ are the main gas source and pumping of noble gases is not an issue.

A particular type of getter pump using a plurality of disks of getter material mounted on a central support is described in EP 0742370 and EP 0753663 both in the applicant's name, while a pump containing a plurality of such elements is described in U.S. Pat. No. 6,149,392 in the applicant's name, whose teachings and content are herein incorporated by reference.

In U.S. Pat. No. 6,149,392 it is recognized that for some applications is it more important and crucial to have a high gas sorption velocity rather than a high gas sorption capacity, a typical example being the case of particle accelerators where there are a plurality of vacuum pumps installed in different sections of the accelerator to provide an adequate vacuum level throughout the whole length.

The inventors have further investigated this problem and have found an alternate and different configuration capable of further improving the pumping speed. In a first aspect thereof the invention consists in a getter pump comprising a casing, whose shape is a solid of revolution, and a plurality of getter cartridges mounted within said getter pump casing, each cartridge comprising a linear central support and spaced getter elements mounted on said linear central support. A plane containing a linear central support and parallel to the solid of revolution axis is defined a getter cartridge "orientation plane", a plane orthogonal to the casing axis and intersecting the midpoint of a linear central support is defined a getter cartridge "positioning plane", the pump being characterized in that the angles formed by the positioning planes with the linear central supports are equal to or less than 30°, preferably equal to or less than 10°.

The expression "solid of revolution" is intended to comprise all those solid figures obtained by revolving a plane area about a given axis that lies in the same plane, also defined as "revolution axis". In its common and most useful embodiment for the present invention the solid of revolution is a cylinder, while other useful shapes are cones or truncated cones or combinations thereof. Moreover for the purposes of the present invention, taking into account that the solid of revolution is an ideal shape and that the pump case is instead a real object, minor deviations from the ideal geometrical revolution shape are still within its breadth and scope.

In view of the fact that in the most preferred embodiment the solid of revolution is a cylinder, in the following examples particular reference will be made to such shape for the getter pump casing, but this is to be regarded only as a non-limiting embodiment of the wider concept of a solid of revolution as suitable geometry for the getter pump external casing.

Figure 1A:
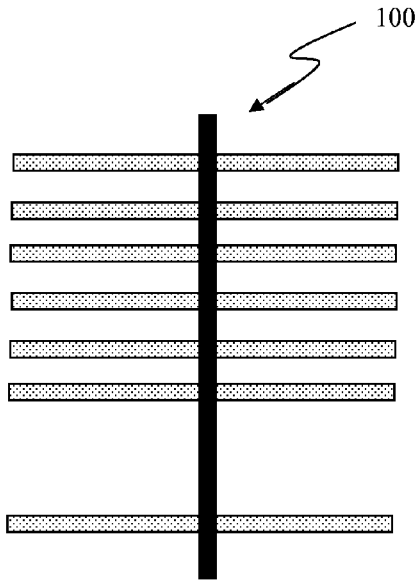
Figure 2:
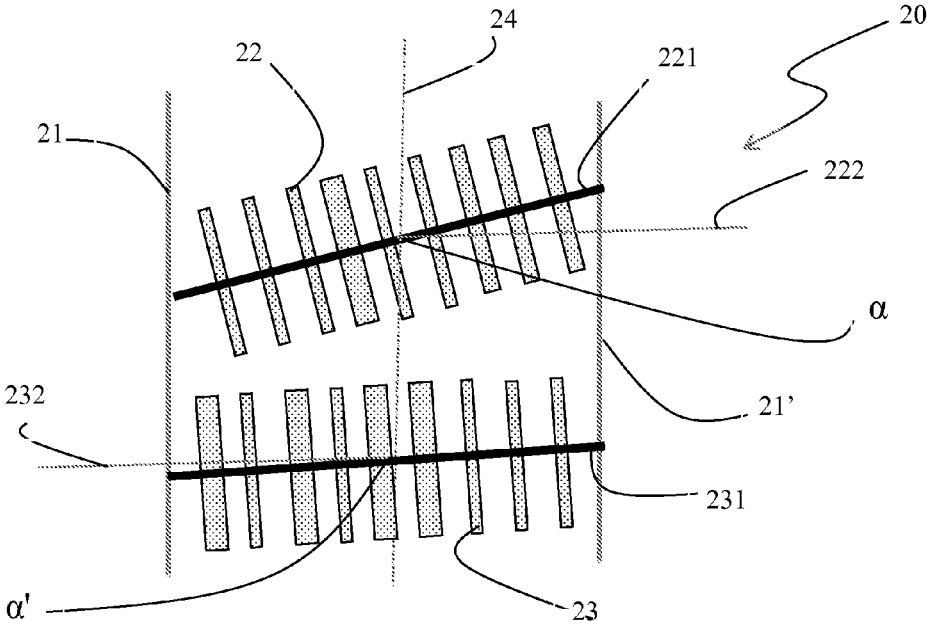
Figure 3:
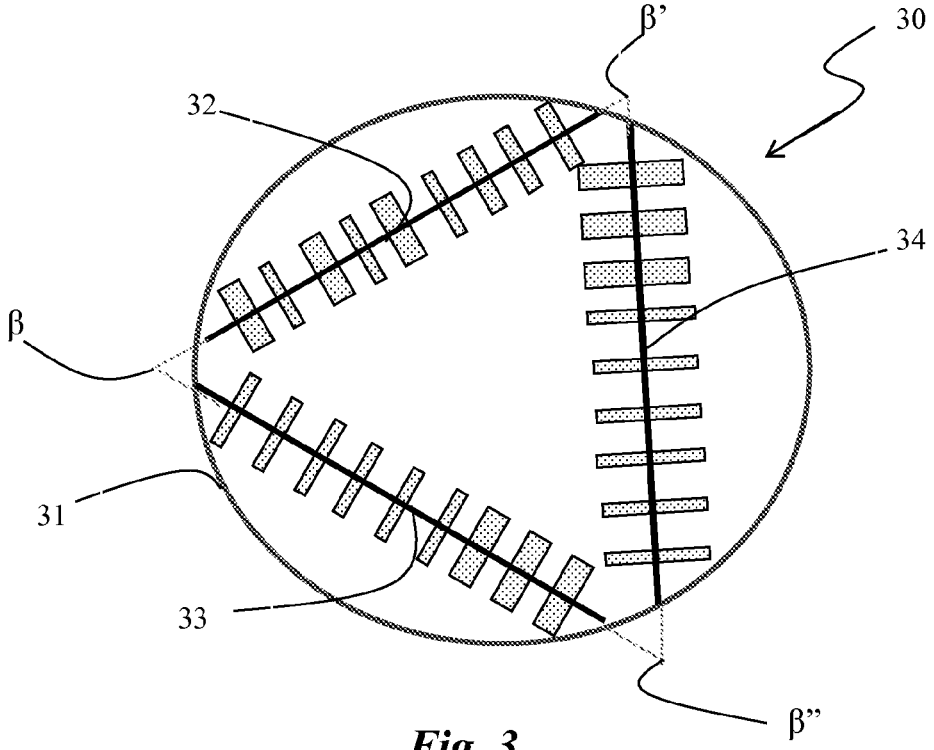

The invention will be further illustrated with the help of the following figures, where:

FIG. 1 shows a schematic representation of a getter cartridge according to the prior art and herein used as constituting element in the getter pump according to the present invention, FIG. 1A shows a schematic representation of a variation of a getter cartridge according to the prior art FIG. 2 shows a cross-sectional view of an embodiment of a getter pump according to the present invention, FIG. 3 shows a top plan view of an embodiment of a getter pump according to the present invention.

Figure 3A:
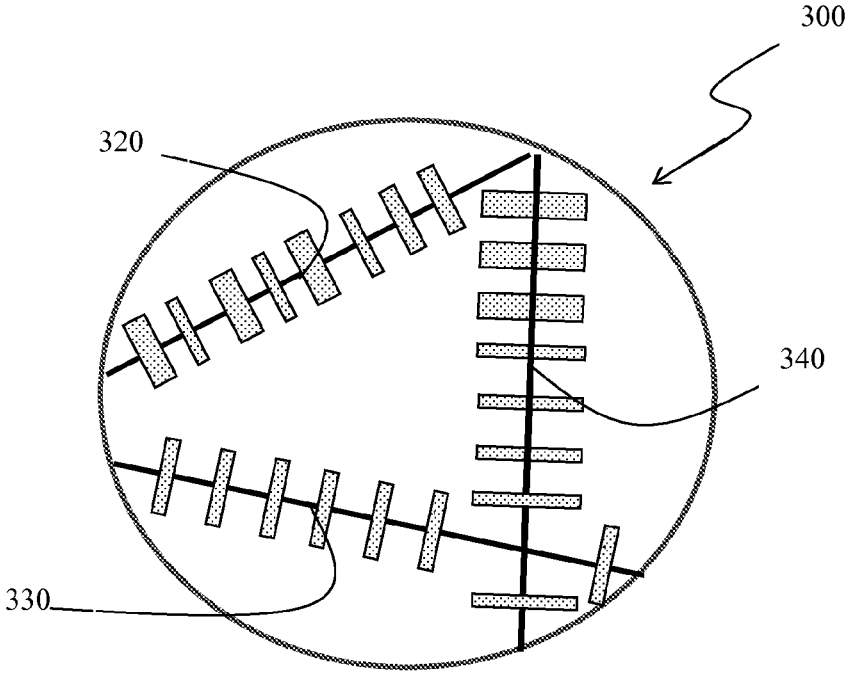

FIG. 3A shows a top plan view of a variation of the embodiment depicted in FIG. 3.

In the figures, the dimensions and dimensional ratios of the elements may not be correct and in some cases, such as for example in FIG. 1 the diameters of the spaced getter elements, in the form of disks, with respect to the central shaft diameter, have been altered in order to improve the figure comprehensibility.

The getter pump according to the present invention envisions the presence of a plurality of getter cartridges, such as the one schematically represented in FIG. 1, each getter cartridge 10 having a central shaft 11 acting as support and a plurality of spaced getter elements 12, 12', . . . $\mathbf{12}_n$, typically and most preferably having the shape of disks. In FIG. 1 the means fixing the getter disks to the central shaft have not been shown since they are not necessary for the comprehension of the invention and within the knowledge of a person skilled in the art.

As shown in FIG. 1A, an alternate getter cartridge 100 suitable to be used in getter pumps according to the present invention can have getter disks that are not equally spaced but there may be some gaps/voids at the extremities or within the disk stack. Those spaces are useful in case there are encumbrances to be taken into account given by the cartridges themselves or other elements, such as for example, power supply cables or feed-throughs. Therefore getter cartridges having the plurality of getter elements essentially equally spaced is just a preferred and non-limiting example of suitable getter cartridges to be used in the pumps according to the present invention.

The features and characteristics of the getter cartridges will not be described in greater detail since this knowledge is in possession of a person skilled in the art, in any case some details and information are present in the already mentioned EP 0742370 and EP 0753663. In the present invention it is necessary for the shaft 11 acting as support of the getter elements to be linear, such as shown in FIG. 1, in EP 0742370, in EP 0753663 and in U.S. Pat. No. 6,149,392, while a configuration such as the one shown in WO 9858173 would not be suitable. The most useful shape for the linear shaft/support is cylindrical.

It should also be noted that the invention is not limited to a specific getter material, but any suitable material capable to sorb gases and to be reactivated by means of a thermal treatment may be employed and falls within the definition of getter materials for the scope and purposes of the present invention. The knowledge and characteristics of such materials are available to a person skilled in the art and may be easily retrieved from various sources, such as, for example, the above mentioned EP 0742370. Particularly advantageous are getter metals or alloys comprising at least 30% of one or more of titanium, zirconium, yttrium.

The inventors, in trying to further improve the speed of a getter pump using a plurality of getter cartridges, have found specific configurations that provide improvements with respect to the ones described in U.S. Pat. No. 6,149,392.

In particular, FIG. 2 shows a longitudinal cross-sectional view of a portion of a getter pump according to the present invention. The getter pump portion 20 has a cylindrical casing defined by two side walls 21 and 21', and its geometry is further defined by a revolution axis 24. Within the casing are contained two getter cartridges 22 and 23, each with its own positioning plane 222 and 232 orthogonal to the revolution axis 24 and intersecting the midpoint of the cartridge supports 221 and 231. The angles formed by each positioning plane with each getter cartridge linear support, 221 and 231, are respectively indicated with $\alpha$ and $\alpha'$. For getter pumps according to the present invention it is necessary that those angles are not higher than 30°, and preferably less than 10°.

The getter pump shown in FIG. 2 has two getter cartridges with two different positioning planes, i.e. with positioning planes whose distance is greater than 1,5 cm; the distance of the positioning planes is easily determinable, since by virtue of their definition they are parallel to each other.

Getter cartridges whose positioning planes have a distance smaller than 1,5 cm are considered getter cartridges lying essentially in the same plane, which will be defined as a getter "subassembly plane" and is coincident with the lowest positioning plane (i.e. the one upstream with respect to the flow direction) of the getter cartridges lying in essentially the same plane.

In FIG. 2 the means connecting the getter cartridges to the casing have not been shown since they are conventional and widely known to a person skilled in the art, such as for example soldering. In this regard it is important to underline that the terminal part of the linear central support may possibly be bent to ease its fixing onto the casing, whereby the central support must be linear at least in the portion holding the getter disks.

With regards to the getter cartridges suitable to be used in the getter pump structure according to the present invention, those have a linear central support whose length is comprised between 4 and 30 cm, holding between 2 and 7 getter disks per cm in the disk-holding portion.

Moreover additional elements external to the getter pump such as a power supply and control elements have not been shown since they are conventional. Their purpose is typically to supply current to the linear central support of the getter cartridges so that the getter disks are reactivated by heating the support. With regards to heating, this may be alternatively provided by external sources that heat the casing of the getter pump, such sources possibly being already present in the system where the getter pump is installed, since the system often envisions the presence of baking systems that in some cases may advantageously be used also to heat up and activate the getter pump.

With regards to the casing, that is preferably cylindrical, there are two preferred embodiments. In the first one the casing is closed at one end by a metallic base, usually made with the same material of the side wall, and at the other end by a standard vacuum flange.

In a second preferred embodiment the casing is defined only by the side wall, in this configuration the getter pump has an open-ended casing, so that gas molecules can travel across the getter pump. This configuration is useful when the pump may be directly integrated, for example co-axially, in systems rather than being an additional element, as for example in the case of wall sections of particle accelerators that may be substituted with getter pumps according to the present invention, with a casing made according to the second preferred embodiment. This getter pump configuration allows distributing large sorption velocity and capacity inside the main section of particle accelerator without interfering with any particle or electron beam moving through it.

Even though the getter pumps according to the present invention are most suitably used as stand-alone pumps, they can also be used in pumping systems coupled with other types of pumps, such as for example turbomolecular pumps, Sputter Ion Pumps (SIP), cryogenic pumps, or other NEG (Non Evaporable Getter) pumps.

A top plan view of a getter pump with getter cartridges that are in a same getter subassembly plane is shown in FIG. 3. The getter pump 30 has a cylindrical casing 31 and three getter cartridges 32, 33, 34 in the same getter subassembly plane with a triangular arrangement. The getter cartridge orientation planes for cartridges 32 and 33 form an angle $\beta$, for cartridges 32 and 34 form an angle $\beta'$, and for cartridges 33 and 34 form an angle $\beta''$. In the embodiment shown in FIG. 3 approximately $\beta=\beta'=\beta''=60°$.

It is to be remarked that FIG. 3 is only representative, since the triangle may not be equilateral. This applies also to the size and number of the cartridges lying in the same getter subassembly plane, for example their lengths may differ and give rise to different geometrical polygons with apexes defined by all the possible intersections of the getter cartridges orientation planes. Such polygons fulfil the preferred condition that all the angles formed by the orientation planes for the getter cartridges lying in the same subassembly plane are less than 130°, even more preferably are equal to or less than 90°.

An interesting variation of the embodiment shown in FIG. 3, is depicted in FIG. 3A, showing a top plan view of a getter pump 300 made with two cartridges 330, 340 where some getter disks are not present (those are the cartridges shown in FIG. 1A), and one standard getter cartridge 320 in which the disks are essentially equally/uniformly spaced.

By comparing systems using the same number of cartridges, this will result in a reduced capacity and speed with respect to standard cartridges. But the advantages lies in the fact that there is more flexibility in terms of placing of the getter cartridges, allowing to take into account case or geometries constraints, and therefore allowing to place in the pump a higher number of cartridges, resulting at the end in an overall improvement in the pump technical characteristics.

In a getter pump according to the present invention it is particularly useful to have a plurality of cartridges in a plurality of getter subassembly planes. The number of getter subassembly planes is determined by the length of the getter pump casing, such number being preferably comprised between 40 and 80 per meter, scaling accordingly for casings whose length is less than 1 meter.

Each subassembly plane may have a different number of getter cartridges arranged according to different configurations. In this case it is preferred that the adjacent polygon apexes in different getter subassembly planes are not aligned parallel to the revolution axis, but rather that the lines connecting adjacent polygon apexes lying in different subassembly planes form with the subassembly planes themselves (which are parallel to each other) angles equal to or less than 80°, preferably less than 60°.

The invention will be further illustrated with the help of the following non-limiting examples.

EXAMPLE 1

A set of getter cartridges is prepared, each cartridge comprising 39 disks with a 1,3 mm spacing. The getter material used for the disks is a Zr (82 wt %)—V (14,8 wt %)—Fe (3,2 wt %) alloy, marketed by the applicant under the trade name "St 172". The disks have a 1 mm thickness and a diameter of 25,4 mm. At the terminal parts of the cartridges 24,8 mm are free of getter elements, whereby the overall length of the linear support is 140 mm.

The evaluation of the pumping speed of a pump according to the present invention is made, the pump consisting of a cylindrical casing with a height of 140 mm and a diameter of 160 mm , closed at one end by a base and at the opposite end by a vacuum flange. Six cartridges are arranged into two distinct subassembly planes with a 3 cm distance therebetween, the getter cartridges orientation planes for the cartridges in a same subassembly plane forming an equilateral triangle, while the angle formed by the lines connecting the adjacent polygon apexes lying in different getter subassembly planes is about 23°. The result of the evaluation gives a pumping speed higher than 2500 l/s.

EXAMPLE 2 (COMPARATIVE)

Other getter cartridges from the same set of example 1 are used to evaluate the pumping speed of a getter pump according to the prior art. The closed getter pump casing has the same diameter and height as in example 1, but with the cartridges mounted in such a way that the angles formed by the positioning planes with the linear central supports are 90°, i.e. the linear supports are parallel to the walls of the casing, and the cartridges are disposed around the perimeter of the casing and equally spaced among each other. In this case the result of the evaluation provides a pumping speed lower than 2200 l/s.

The invention claimed is:

1. A getter pump, comprising:

a casing, whose shape is a solid of revolution with a revolution axis, and a plurality of getter cartridges mounted within said getter pump casing, each cartridge comprising a linear central support and spaced getter elements mounted on said linear central support, wherein, for each getter cartridge a getter cartridge orientation plane containing the linear central support and parallel to the revolution axis is defined, a getter cartridge positioning plane orthogonal to the revolution axis and intersecting the midpoint of the linear central support is defined, and an angle formed by said getter cartridge positioning plane with the linear central support is equal to or less than 30°.

2. The getter pump according to claim 1, wherein said solid of revolution is chosen from the group of cylinder, cone, truncated cone.

3. The getter pump according to claim 1, wherein said spaced getter elements are made with metals or alloys comprising at least 30% of one or more of titanium, zirconium, yttrium.

4. The getter pump according to claim 1, wherein said linear central support has a length comprised between 4 cm and 30 cm.

5. The getter pump according to claim 1, wherein said casing is closed at one end by a base and at the opposite end by a vacuum flange.

6. The getter pump according to claim 1, wherein said casing is open-ended.

7. The getter pump according to claim 1, wherein getter subassembly positioning planes of at least two getter cartridges have a distance between the getter subassembly positioning planes being smaller than 1.5 cm whereby said at least two getter cartridges lay in essentially the same getter subassembly positioning plane.

8. The getter pump according to claim 7, wherein angles at apexes of a polygon formed by the orientation planes for getter cartridges laying in a same getter subassembly plane are equal to or less than 130°.

9. The getter pump according to claim 8, wherein a same getter subassembly plane includes three getter cartridges arranged in a triangular configuration.

10. The getter pump according to 8, wherein a same getter subassembly plane includes four getter cartridges arranged in a square configuration.

11. The getter pump according to claim 8, wherein the lines connecting adjacent polygon apexes lying in different getter subassembly planes form with the subassembly planes themselves angles equal to or less than 80°.

12. The getter pump according to claim 7, wherein the number of getter subassembly planes is comprised between 40 and 80 per meter of length of the pump casing.

13. A method comprising:

using the getter pump according to claim 1 in a pumping system comprising different types of vacuum pumps.

14. A method comprising:

using the getter pump according to claim 1 in a pumping system comprising different types of vacuum pumps, wherein said vacuum pumps comprise a vacuum pump chosen from the group of sputter ion pump, turbomolecular pump, cryogenic pump, NEG pump.

15. The getter pump according to claim 4, wherein said linear central support carries between 2 and 7 getter elements per cm.

16. The getter pump according to claim 8, wherein the angles at the apexes of the polygon formed by the orientation planes for getter cartridges laying in a same getter subassembly plane is equal to or less than 90°.

17. The getter pump according to claim 11, wherein the lines connecting adjacent polygon apexes lying in different getter subassembly planes form with the subassembly planes themselves angles less than 60°.

18. The getter pump according to claim 1, wherein the angle formed by said getter cartridge positioning plane with the linear central support is equal to or less than 10°.

* * * * *